US009799966B2

(12) United States Patent
Tsai et al.

(10) Patent No.: US 9,799,966 B2
(45) Date of Patent: Oct. 24, 2017

(54) ELECTRICAL PLUG CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Long-Fei Chen, New Taipei (TW); Chien-Tsung Chuang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 0 days.

(21) Appl. No.: 15/170,349

(22) Filed: Jun. 1, 2016

(65) Prior Publication Data

US 2016/0359242 A1 Dec. 8, 2016

(30) Foreign Application Priority Data

Jun. 3, 2015 (CN) ..... 2015 1 0296448

(51) Int. Cl.

| | |
|---|---|
| ***H01R 4/24*** | (2006.01) |
| ***H01R 13/6581*** | (2011.01) |
| ***H01R 13/6471*** | (2011.01) |
| ***H01R 13/11*** | (2006.01) |
| ***H01R 13/502*** | (2006.01) |
| *H01R 107/00* | (2006.01) |

(52) U.S. Cl.

CPC ..... *H01R 4/2404* (2013.01); *H01R 13/112* (2013.01); *H01R 13/502* (2013.01); *H01R 13/6471* (2013.01); *H01R 13/6581* (2013.01); *H01R 2107/00* (2013.01)

(58) Field of Classification Search

CPC ..... H01R 4/2433
USPC ..... 439/417, 409, 404, 660
See application file for complete search history.

(56) References Cited

U.S. PATENT DOCUMENTS

| | | | | |
|---|---|---|---|---|
| 4,915,645 A * | 4/1990 | Konnemann | ..... | H01R 13/4361 439/417 |
| 6,146,205 A * | 11/2000 | Lai | ..... | H01R 13/6275 439/358 |
| 6,165,017 A * | 12/2000 | Kuo | ..... | H01R 13/6275 439/357 |
| 6,203,328 B1 * | 3/2001 | Ortega | ..... | H01R 12/721 439/60 |

(Continued)

*Primary Examiner* — Neil Abrams
(74) *Attorney, Agent, or Firm* — Muncy, Geissler, Olds & Lowe, P.C.

(57) ABSTRACT

An electrical plug connector includes a metallic shell, an insulated housing, a plurality of plug terminals, a plurality of tooth portions, and a wire organizer. The insulated housing is received in the metallic shell. The plug terminals are held at the insulated housing. Each of the power terminal and the ground terminal of the plug terminals includes a clamping structure. Each of the tooth portions is extending from rear of the corresponding plug terminal. The wire organizer is assembled to the insulated housing. Each of the tooth portions is inserted into the corresponding wire groove of the wire organizer to connect to a corresponding wire when the wires held in the wire organizer are pressed against the tooth portions. Each power and ground terminals may include either a single one or a pair of flexible contact portions.

19 Claims, 15 Drawing Sheets

(56) References Cited

U.S. PATENT DOCUMENTS

| | | | | |
|---|---|---|---|---|
| 6,716,056 | B1 * | 4/2004 | Hsu | H01R 4/2429 439/406 |
| 6,923,664 | B2 * | 8/2005 | Ito | H01R 13/6585 439/108 |
| 7,059,914 | B2 * | 6/2006 | Tsai | H01R 24/60 439/417 |
| 7,438,565 | B2 * | 10/2008 | Hamazaki | H01R 13/6658 439/108 |
| 7,458,829 | B2 * | 12/2008 | Shioda | H01R 12/57 439/108 |
| 7,604,510 | B2 * | 10/2009 | Akama | H01R 23/688 439/637 |
| 7,845,968 | B1 * | 12/2010 | Huss, Jr. | H01R 4/2404 439/409 |
| 7,934,941 | B2 * | 5/2011 | Hayauchi | H01R 4/2433 439/417 |
| 8,047,875 | B2 * | 11/2011 | Yamakami | H01R 13/6315 439/108 |
| 9,017,092 | B1 * | 4/2015 | McCracken | H01R 13/62 439/374 |
| 9,325,128 | B2 * | 4/2016 | Chen | H01R 12/724 |
| 9,431,767 | B2 * | 8/2016 | Wu | H01R 13/6463 |
| 9,502,837 | B2 * | 11/2016 | Kuramoto | H01R 24/60 |
| 9,577,373 | B2 * | 2/2017 | Kato | H01R 13/6275 |
| 9,590,353 | B2 * | 3/2017 | Regnier | H01R 24/62 |
| 2015/0244111 | A1 * | 8/2015 | Ju | H01R 13/6585 439/607.05 |

* cited by examiner

100

100

100

| | | | | | | | | | |
|---|---|---|---|---|---|---|---|---|---|
| | | | VBUS | | D− | D+ | | | GND |
| | | | VBUS | | | | | | GND |

Fig. 7

| | | | | | | | | | | | |
|---|---|---|---|---|---|---|---|---|---|---|---|
| GND | RX2+ | RX2- | VBUS | SBU1 | D+ | D- | CC | VBUS | RX2+ | RX2- | GND |
| GND | TX2+ | TX2- | VBUS | VCON | D- | D+ | SBU2 | VBUS | TX2+ | TX2- | GND |

Fig. 15

ELECTRICAL PLUG CONNECTOR

CROSS-REFERENCES TO RELATED APPLICATIONS

This non-provisional application claims priority under 35 U.S.C. §119(a) on Patent Application No. 201510296448.7 filed in China, P.R.C. on Jun. 3, 2015, the entire contents of which are hereby incorporated by reference.

FIELD OF THE INVENTION

The instant disclosure relates to an electrical connector, and more particular to an electrical plug connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical plug connector includes a plastic core, upper and lower plug terminals formed with the plastic core, and an outer iron shell enclosing the plastic core. Normally, the rears of the plug terminals are connected with wires by soldering means, so that the USB type-C electrical plug connector can be provided as a connection cable for transmitting power and signal terminals through the plug terminals and the wires.

SUMMARY OF THE INVENTION

However, the upper plug terminals and the lower plug terminals are separated and assembled to the plastic core individually. As a result, the difficulty and cost during the assembly process increase. In addition, the soldering between the upper plug terminals and the lower plug terminals is difficult and complicated. In the assembly, the wires are required to be aligned with the plug terminals, and the soldering wires (or the plug terminals) should not be in contact with each other to cause short circuit.

Consequently, how to improve the existing electrical plug connector becomes an issue.

In view of these, an exemplary embodiment of the instant disclosure provides an electrical plug connector. The electrical plug connector comprises a metallic shell, an insulated housing, a plurality of plug terminals, a plurality of tooth portions, and a wire organizer. The metallic shell defines a receiving cavity therein. The insulated housing is received in the receiving cavity of the metallic shell and comprises a base portion, a tubular portion, a mating room, and an assembling groove. The tubular portion comprises a first portion and a second portion, and the tubular portion is extending from one of two sides of the base portion. The mating room is between the first portion and the second portion. The assembling groove is formed at the other side of the base portion. The plug terminals comprise a plurality of signal terminals, a power terminal, and a ground terminal. Each of some of the plug terminals comprises a first flexible contact portion, a second flexible contact portion, and a body portion. The body portions are held in the base portion. For each of the signal terminals, the first flexible contact portion is extending from one of two ends of the body portion and held at the first mating surface of the first portion or at the second mating surface of the second portion. For each of the power terminal and the ground terminal, the first flexible contact portion, the second flexible contact portion, and the body portion are formed as a clamping structure. For each of the clamping structures, the first flexible contact portion is extending upward form the end of the body portion and at the first mating surface of the first portion, and the second flexible contact portion is extending downward from the end of the body portion and at the second mating surface of the second portion. Each of the tooth portions is extending from the other end of each of the body portions and extending toward the assembling groove. The wire organizer is assembled in the assembling groove of the insulated housing. The wire organizer comprises a block body, a plurality of wire grooves, and a plurality of cut grooves. Each of the wire grooves is defined through the block body. Each of the cut grooves is formed at a bottom of the block body and communicating with the corresponding wire groove. Each of the tooth portions is inserted into the corresponding wire groove from the corresponding cut groove.

In some embodiments, each of the tooth portions comprises an extending portion and a plurality of sharp end portions. The extending portion of each of the tooth portions is extending from the other end of the corresponding body portion toward the assembling groove. The sharp end portions are extending from a top of the extending portion of each of the tooth portions and located in the corresponding wire groove.

In some embodiments, each of the clamping structures comprises a clamping region formed between the first flexible contact portion and the second flexible contact portion.

In some embodiments, the electrical plug connector further comprises a plurality of wires inserted into the wire grooves. Each of the tooth portions punctures the corresponding wire.

In some embodiments, the electrical plug connector further comprises a plurality of engaging members respectively at two sides of the insulted housing. Each of the engaging members comprises a hook and a protruding contact portion. The protruding contact portion is extending from the front of the hook portion toward the mating room of the insulated housing, and the hook portions are respectively fixed with the two sides of the insulated housing.

Another exemplary embodiment of the instant disclosure provides an electrical plug connector. The electrical plug connector comprises a metallic shell, an insulated housing, a plurality of plug terminals, a plurality of tooth portions, and a wire organizer. The metallic shell defines a receiving cavity therein. The insulated housing is received in the receiving cavity of the metallic shell and comprises a base portion, a tubular portion, a mating room, and an assembling groove. The tubular portion comprises a first portion and a second portion, and the tubular portion is extending from one of two sides of the base portion. The mating room is between the first portion and the second portion. The assembling groove is formed at the other side of the base portion. The plug terminals comprise a plurality of signal terminals, at least one power terminal, and at least one ground terminal. Each of the plug terminals comprises a first flexible contact portion and a body portion. The body portion is held in the base portion. The first flexible contact portion is extending from one of two ends of the body portion and held at the first mating surface of the first portion or the second mating surface of the second portion. Each of the tooth portions is extending from the other end of each of the body portions and extending toward the assembling groove. The wire organizer is assembled in the assembling groove of the insulated housing. The wire organizer comprises a block body, a plurality of wire grooves, and a plurality of cut grooves. Each of the wire grooves is defined through the block body. Each of the cut grooves is formed at a bottom of the block body and communicating with the corresponding wire groove. Each of the tooth portions is inserted into the corresponding wire groove from the corresponding cut groove.

Yet another exemplary embodiment of the instant disclosure provides an electrical plug connector. The electrical plug connector comprises a metallic shell, an insulated housing, a plurality of plug terminals, a plurality of tooth portions, and a wire organizer. The metallic shell defines a receiving cavity therein. The insulated housing is received in the receiving cavity of the metallic shell and comprises a base portion, a tubular portion, a mating room, and an assembling groove. The tubular portion comprises a first portion and a second portion, and the tubular portion is extending from one of two sides of the base portion. The mating room is between the first portion and the second portion. The assembling groove is formed at the other side of the base portion. The plug terminals comprise a plurality of signal terminals, at least one power terminal, and at least one ground terminal. Each of the plug terminals comprises a first flexible contact portion, a second flexible contact portion, and a body portion. The body portions are held in the base portion. The first flexible contact portion is extending upward from one of two ends of the body portion and held at the first mating surface of the first portion. The second flexible contact portion is extending downward from the end of the body portion and held at the second mating surface of the second portion. The first flexible contact portion, the second flexible contact portion, and the body portion of each of the plug terminals are formed as a clamping structure. For each of the clamping structures, the first flexible contact portion is extending upward from the end of the body portion and at the first mating surface of the first portion, and the second flexible contact portion is extending downward from the end of the body portion and at the second mating surface of the second portion. Each of the tooth portions is extending from the other end of each of the body portions and extending toward the assembling groove. The wire organizer is assembled in the assembling groove of the insulated housing. The wire organizer comprises a block body, a plurality of wire grooves, and a plurality of cut grooves. Each of the wire grooves is defined through the block body. Each of the cut grooves is formed at a bottom of the block body and communicating with the corresponding wire groove. Each of the tooth portions is inserted into the corresponding wire groove from the corresponding cut groove.

Still yet another exemplary embodiment of the instant disclosure provides an electrical plug connector. The electrical plug connector comprises a metallic shell, an insulated housing, a plurality of plug terminals, a plurality of tooth portions, and a wire organizer. The metallic shell defines a receiving cavity therein. The insulated housing is received in the receiving cavity of the metallic shell and comprises a base portion, a tubular portion, a mating room, and an assembling groove. The tubular portion comprises a first portion and a second portion, and the tubular portion is extending from one of two sides of the base portion. The mating room is between the first portion and the second portion. The assembling groove is formed at the other side of the base portion. The plug terminals comprise a plurality of signal terminals, a power terminal, and a ground terminal. Each of the signal terminals comprises a first flexible contact portion and a body portion. Each of the power terminal and the ground terminal comprises a first flexible contact portion, a second flexible contact portion, and a body portion. The body portions are held in the base portion. The first flexible contact portion of each of the signal terminals is extending from one of two ends of the body portion and held at the first mating surface of the first portion or the second mating surface of the second portion. For each of the power terminal and the ground terminal, the first flexible contact portion and the second flexible contact portion are oppositely extending from the end of the body portion and held at the first mating surface of the first portion and the second mating surface of the second portion, respectively. Each of the tooth portions is extending from the other end of each of the body portions and extending toward the assembling groove. The wire organizer is assembled in the assembling groove of the insulated housing. The wire organizer comprises a block body, a plurality of wire grooves, and a plurality of cut grooves. Each of the wire grooves is defined through the block body. Each of the cut grooves is formed at a bottom of the block body and communicating with the corresponding wire groove. Each of the tooth portions is inserted into the corresponding wire groove from the corresponding cut groove.

Accordingly, the first flexible contact portion, the second flexible contact portion, and the body portion of each of the power terminal and the ground terminal are formed as the clamping structure. Therefore, the power terminal and the ground terminal can be assembled to the insulated housing by one-time assembling, and the first flexible contact portions and the second flexible contact portions can be received in the mating room and provided as upper and lower terminals. Hence, the conventional problem that the upper terminals and the lower terminals have to be assembled to the insulated housing in a separate and complicated manner can be solved. In addition, the tooth portions of the plug terminals can puncture the surface of the wires, so that the sharp end portions of the plug terminals can be in contact with the sub wires of the wires for electrical conduction. As a result, the complicated soldering procedure adapted in the conventional way for the connection of terminals and wires can be replaced. In addition, the tooth portions may be extending from the rears of the plug terminals each having the first flexible contact portion and the second flexible contact portion. Alternatively, the tooth portions may be extending from the rears of the plug terminals having the first flexible contact portions or the second flexible contact portions. In a further option, the tooth portions may be extending from the rears of the plug terminals in which some of the plug terminals have the first flexible contact portion and the second flexible contact portion.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 7 illustrates a schematic configuration diagram of the plug terminals of the electrical plug connector shown in FIG. 6;

FIG. 15 illustrates a schematic configuration diagram of the plug terminals of the electrical plug connector shown in FIG. 14.

DETAILED DESCRIPTION

Figure 1:
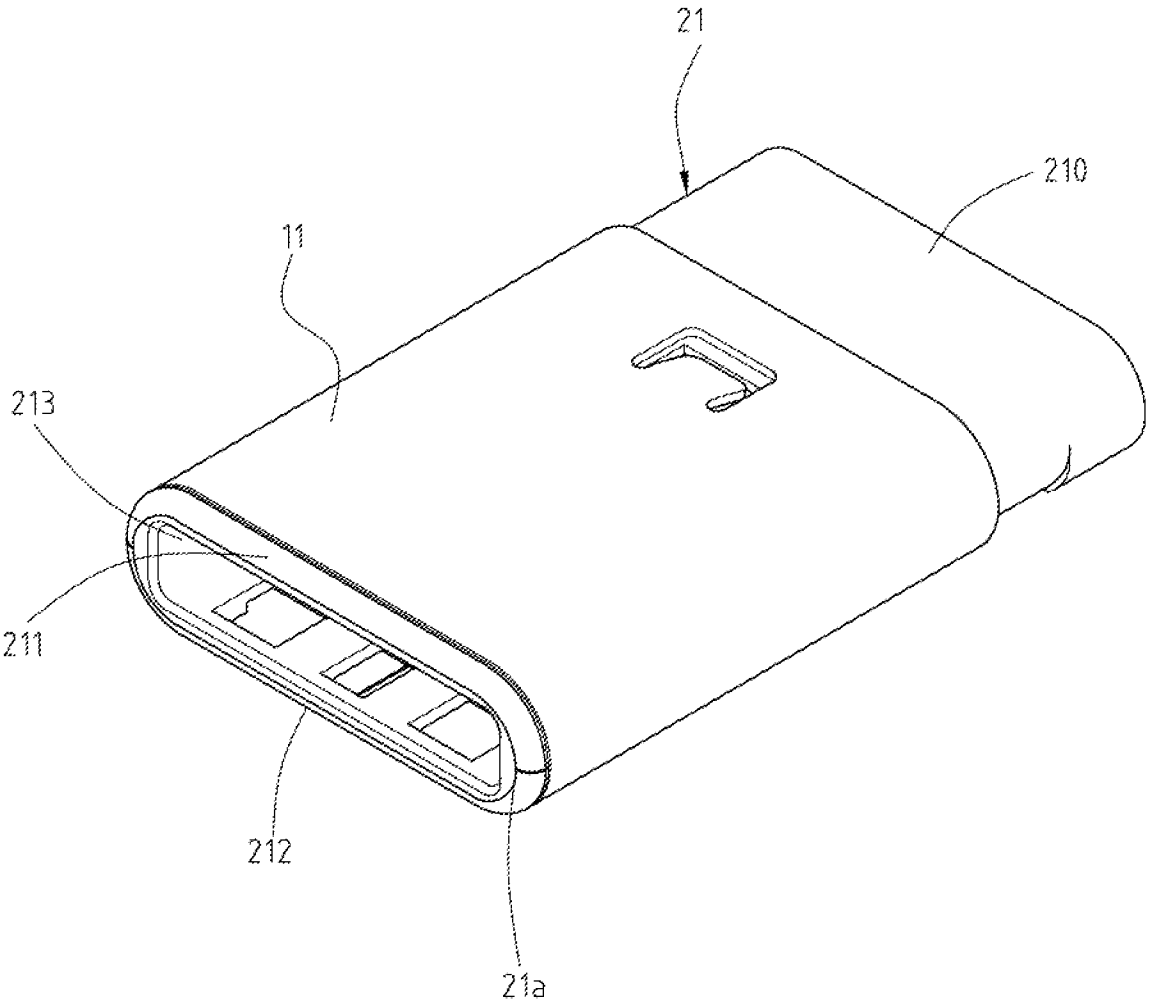
FIG. 1 illustrates a perspective view of an electrical plug connector according to a first embodiment of the instant disclosure.
Figure 2:
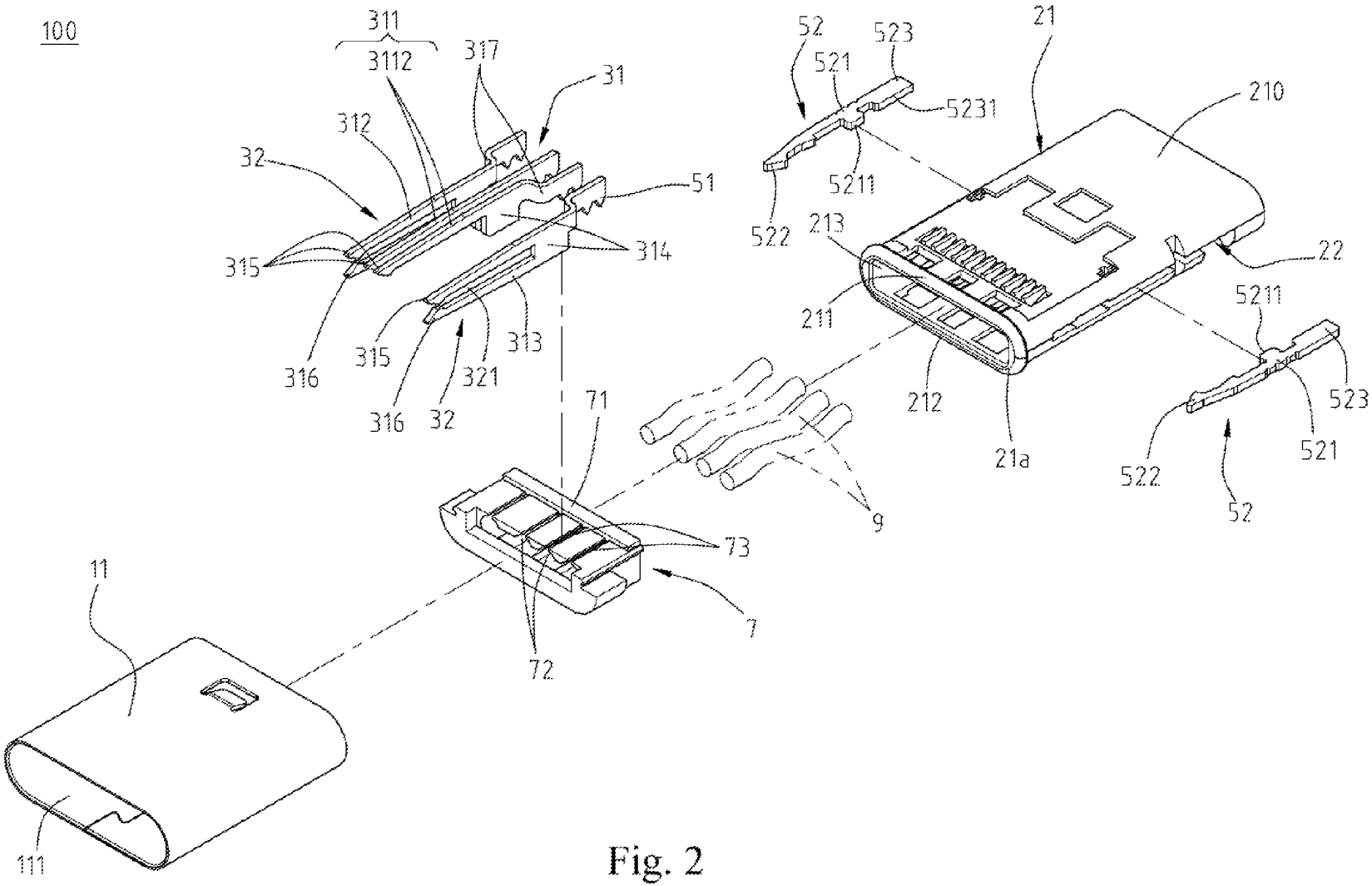
FIG. 2 illustrates an exploded view of the electrical plug connector of the first embodiment.
Figure 3:
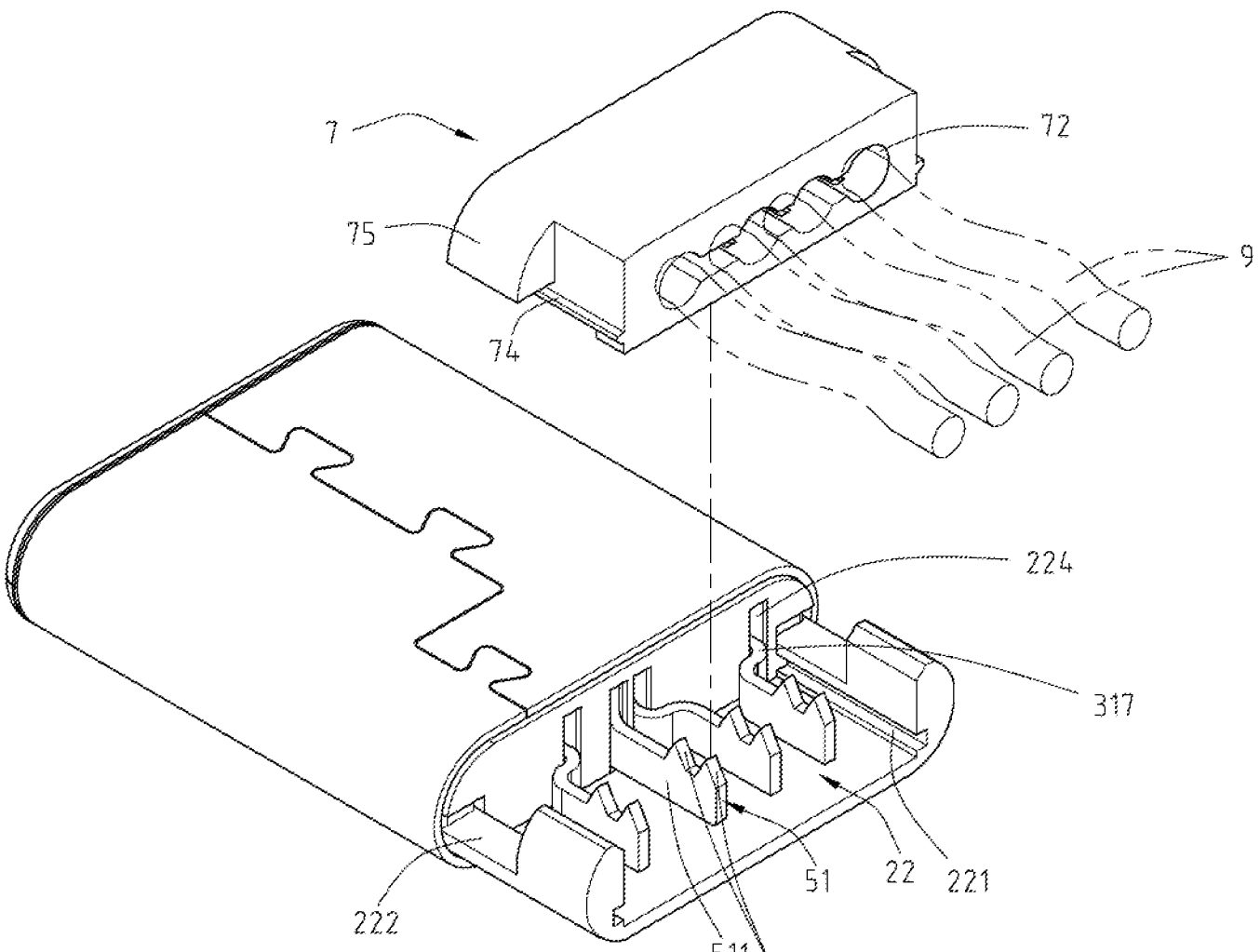
FIG. 3 illustrates an exploded view of wires and the electrical plug connector of the first embodiment.

Please refer to FIGS. 1 to 3, illustrating a first embodiment of the instant disclosure. The first embodiment is an exemplary embodiment showing an electrical plug connector 100 assembled with wires 9 to form a connection cable, but embodiments are not limited thereto. In this embodiment, the electrical plug connector 100 can provide a reversible or dual orientation USB Type-C connector interface and pin assignments, i.e., a USB Type-C plug connector for transmitting USB 2.0 signals. In this embodiment, the electrical plug connector 100 comprises a metallic shell 11, an insulated housing 21, a plurality of plug terminals 31, a plurality of tooth portions 51, and a wire organizer 7.

Please refer to FIGS. 2 to 3. The metallic shell 11 is a hollowed shell and defines a receiving cavity 111 therein. In this embodiment, the metallic shell 11 may be a multi-piece member or a unitary member. Moreover, an insertion opening, of oblong or rectangular shape, is formed at one side of the metallic shell 11, and the insertion opening communicates with the receiving cavity 111.

Please refer to FIGS. 2 and 3. The insulated housing 21 comprises a base portion 210, a tubular portion 21*a*, a mating room 213, and an assembling groove 22. Here, the base portion 210 and the tubular portion 21*a* are injection molded or the like to form the insulated housing 21. In addition, the tubular portion 21*a* comprises a first portion 211 at the upper portion thereof and a second portion 212 at the lower portion thereof. The tubular portion 21*a* is extending from one side of the base portion 210, and the assembling groove 22 is formed at the other side of the base portion 210. In other words, a U-shaped block is connected to the base portion 210, and the top of the U-shaped block is recessed to form the assembling groove 22. The U-shaped block has two side plates and a bottom plate. In addition, the base portion 210 comprises a plurality of assembling slots 224 defined through the inner wall of the recessed groove 22 and communicating with the mating room 213. The assembling slots 224 are for the insertion of the plug terminals 31. In addition, the mating room 213 is between the first portion 211 and the second portion 212. The first portion 211 has a first mating surface (i.e., lower surface) and a first front lateral surface. The second portion 212 has a second mating surface (i.e., upper surface) and a second front lateral surface. The first mating surface corresponds to (i.e., faces) the second mating surface.

Figure 6:
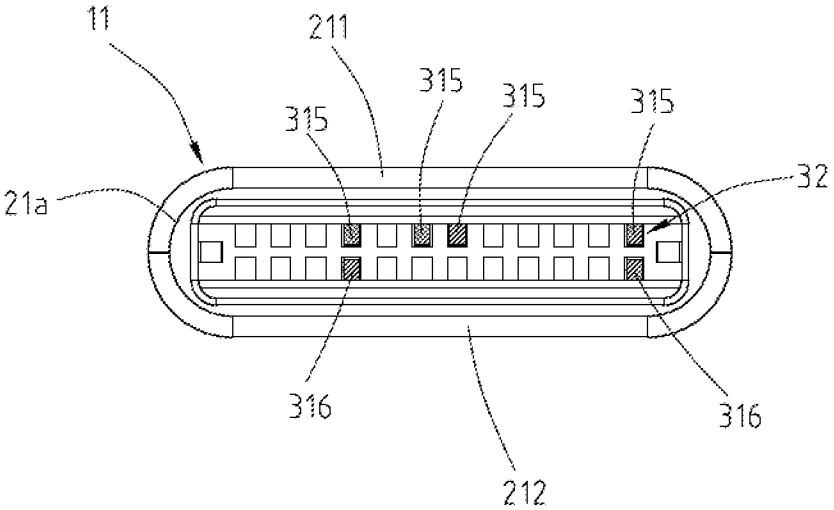
FIG. 6 illustrates a front sectional view of the electrical plug connector of the first embodiment.

Please refer to FIGS. 2, 6, and 7. The first plug terminals 31 comprise a plurality of signal terminals 311, a power terminal 312, and a ground terminal 313. As shown in FIG. 7, the first plug terminals 31 comprise, from right to left, a ground terminal 313 (Gnd), a plurality of low-speed signal terminals 3112 (D+−, differential signal terminals), and a power terminal 312 (Power/VBUS). In other words, in this embodiment, the signal terminals 311 comprise the low-speed signal terminals 3112. However, the pin assignment provided herein is as an illustrative purpose, but not a limitation of the electrical plug connector 100. In some embodiments, the position of the ground terminal 313 and the position of the power terminal 312 may be exchanged. In addition, in this embodiment, the electrical plug connector 100 has four plug terminals 31 for USB 2.0 signal transmission (low-speed signal transmission).

Please refer to FIG. 7 and Table 1. In this embodiment, the four plug terminals 31 are reduced from the twelve plug terminals 31 illustrated in Table 1, showing a pin assignment of plug terminals of a connector having USB Type-C connection interface. Specifically, the relative positions of the remaining four plug terminals 31 are unchanged. In addition, in this embodiment, the ground terminal 313 and the power terminal 312 each has a first flexible contact portion 315, a body portion 314, and a second flexible contact portion 316 integrated with each other, and the low-speed signal terminal 3112 only has a first flexible contact portion 315 and a body portion 314.

TABLE 1

| | | | | | | | | | | | |
|---|---|---|---|---|---|---|---|---|---|---|---|
| A12 | A11 | A10 | A09 | A08 | A07 | A06 | A05 | A4 | A03 | A02 | A1 |
| GND | RX2+ | RX2− | VBUS | SBU1 | D+ | D− | CC | VBUS | RX2+ | RX2− | GND |
| B1 | B02 | B03 | B04 | B05 | B06 | B07 | B08 | B9 | B10 | B11 | B12 |

Please refer to FIGS. 2, 4, 6, 7, and 8. The plug terminals 31 are terminals made by blanking techniques and have improved structural strengths. The plug terminals 31 have the first flexible contact portions 315 and the second flexible contact portions 316 that are flexible and formed integrally with each other. The body portions 314 are held in the base portion 210. The width of the body portion 314 is greater than the width of the first flexible contact portion 315 or the width of the second flexible contact portion 316. When the first flexible contact portions 315 and the second flexible contact portions 316 of the plug terminals 31 are aimed at the assembling slots 224 and inserted into the mating room 213, the side portion of each of the body portions 314 is abutted against the corresponding assembling slot 224, so that the plug terminals 31 can be firmly positioned in the assembling slots 224.

The first flexible contact portion 315 and the second flexible contact portion 316 are respectively extending from one of two ends of the body portion 314 upward and downward toward the mating room 213. The front of the first flexible contact portion 315 and the front of the second flexible contact portion 316 are provided for being in contact with receptacle terminals of an electrical receptacle connector. Each of the signal terminals 311 only comprises the first flexible contact portion 315 (and does not comprise the second flexible contact portion 316). The first flexible contact portion 315 of each of the signal terminals 311 is extending from one of two ends of the body portion 314 and held at the first mating surface of the first portion 211 or the second mating surface of the second portion 212. As shown in FIG. 6, the first flexible contact portions 315 of the signal terminals 311 are held at the first mating surface of the first portion 211 and formed as the upper terminals received in the mating room 213, but embodiments are not limited thereto. In some embodiments, the first flexible contact portions 315 of the signal terminals 311 are held at the second mating surface of the second portion 212, meaning that the first flexible contact portions 315 shown in FIG. 6 may be at a lower portion of the mating room 213 and formed as the lower terminals received in the mating room 213. The first flexible contact portions 315 of the signal terminals 311 are extending toward the mating room 213 for transmitting USB 2.0 signals.

Please refer to FIGS. 2, 4, 6, 7, and 8. Each of the power terminal 312 and the ground terminal 313 comprises the first flexible contact portion 315 and the second flexible contact portion 316 integrated with each other. The first flexible contact portion 315, the second flexible contact portion 316, and the body portion 314 of each of the power terminal 312 and the ground terminal 313 are formed as a clamping structure 32. That is, the cross section of the first flexible contact portion 315, the second flexible contact portion 316, and the body portion 314 is approximately formed as an elongated-C shape profile, or for example, like a harpoon. In addition, for each of the clamping structures 32, the first flexible contact portion 315 is extending upward from the end of the body portion 314 and at the first mating surface of the first portion 211, and the second flexible contact portion 316 is extending downward from the end of the body portion 314 and at the second mating surface of the second portion 212. In other words, the first flexible contact portion 315 and the second flexible contact portion 316 of each of the clamping structures 32 are formed as paired upper and lower terminals in the mating room 213.

In this embodiment, the clamping structure 32 further comprises a clamping region 321 formed between the first flexible contact portion 315 and the second flexible contact portion 316. The clamping region 321 is for the insertion of a tongue portion of an electrical receptacle connector. The front of the first flexible contact portion 315 and the front of the second flexible contact portion 316 of each of the clamping structures 32 are symmetrical with each other and leaned toward each other. In other words, the width of clamping region 321 gradually reduces from the interior toward the opening of the clamping structure 32. When the electrical plug connector 100 is mated with an electrical receptacle connector, an upper surface and a lower surface of a tongue portion of the electrical receptacle connector are respectively pushed against the corresponding lateral surfaces of the first flexible contact portion 315 and the second flexible contact portion 316 of each of the clamping structures 32, and the holding force of the plug terminals 31 for the tongue portion can be improved because of the shape of the clamping structure 32 (i.e., the first flexible contact portion 315 and the second flexible contact portion 316 are aligned inclinedly toward each other). In other words, the distance between the front of the first flexible contact portion 315 and the front of the second flexible contact portion 316 is less than the width of the tongue portion. When the tongue portion is inserted into the space between the first flexible contact portion 315 and the second flexible contact portion 316 (i.e., inserted into the clamping section 321), the tongue portion pushes the first flexible contact portion 315 and the second flexible contact portion 316 away firstly, then the first flexible contact portion 315 and the second flexible contact portion 316 are deflected resiliently, so that the holding force of the plug terminals 31 for the tongue portion can be further improved.

Figure 4:
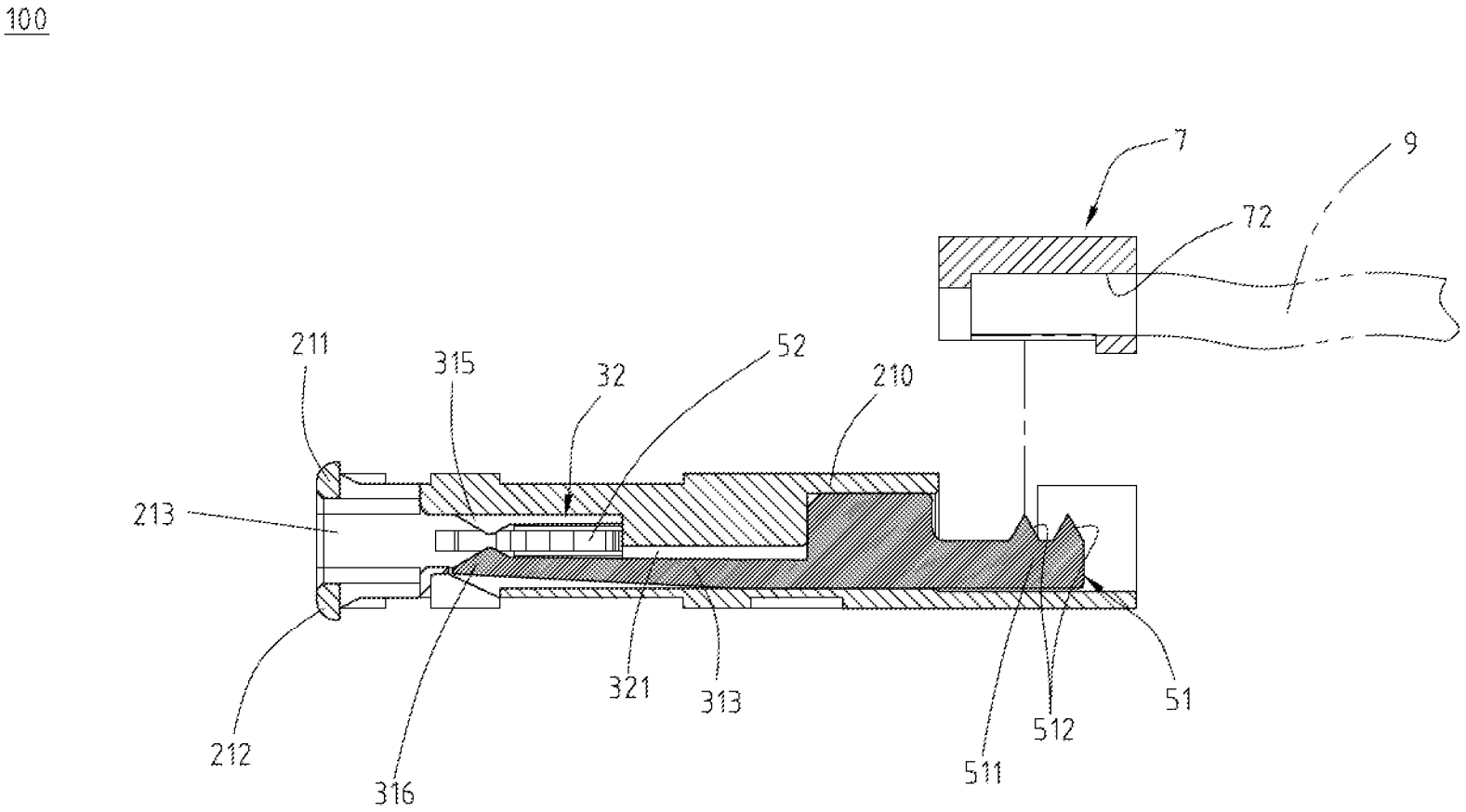
FIG. 4 illustrates a lateral sectional exploded view of a wire organizer and the electrical plug connector of the first embodiment.
Figure 5:
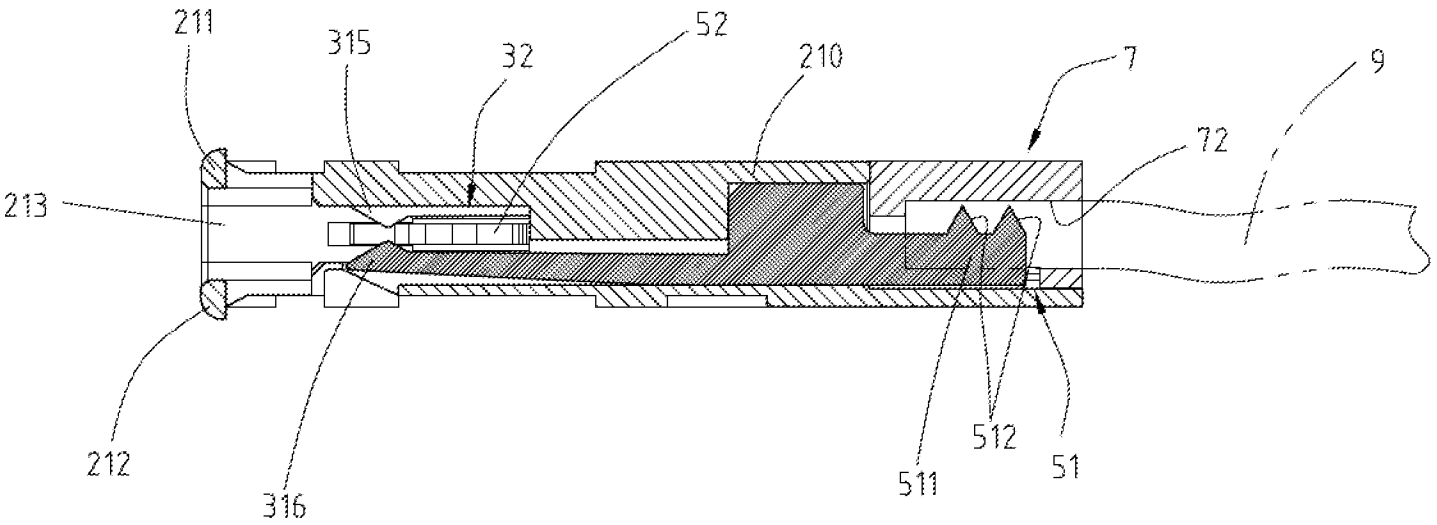
FIG. 5 illustrates a lateral sectional assembled view of an assembly of the wire organizer and the electrical plug connector of the first embodiment.

Please refer to FIGS. 2 to 4. Each of the tooth portions 51 is extending from the other end of the corresponding body portion 314 toward the assembling groove 22. Each of the tooth portions 51 is integrally formed with the corresponding plug terminal 31. Each of the tooth portions 51 comprises an extending portion 511, a plurality of sharp end portions 512, and a turning portion 317. The extending portion 511 is extending from the other end of the body portion 314 toward the assembling groove 22. The sharp end portions 512 are extending from a top of the extending portion 511, spaced from each other, and located in a corresponding wire groove 72 of the wire organizer 7. The sharp end portions 512 are aligned parallel at the top of the extending portion 511 and respectively corresponding to a front portion and a rear portion of a corresponding wire 9. Therefore, the sharp end portions 512 can puncture the surface of the wire 9 and be in contact with the sub wires (i.e., the core wires) in the wire 9. In other words, the sharp end portions 512 of each of the tooth portions 51 puncture the corresponding wire 9 and are in contact with the sub wires of the wire 9 for conduction. Specifically, the electrical plug connector 100 further comprises a plurality of wires 9 respectively inserted into the wire grooves 72 of the wire organizer 7. The tooth portions 51 respectively puncture the surface of the wires 9. The sharp end portions 512 of each of the tooth portions 51 puncture the surface of the corresponding wire 9 and are in contact with the sub wires in the wire 9 for electrical conduction.

Please refer to FIGS. 2 to 4. The turning portion 317 is extending between the extending portion 511 and the body portion 314. The turning portions 317 are for adjusting the distance between the extending portions 511, so that the sharp end portions 512 can be aimed at the respective wires 9 and puncture the surfaces of the wires 9.

Figure 10:
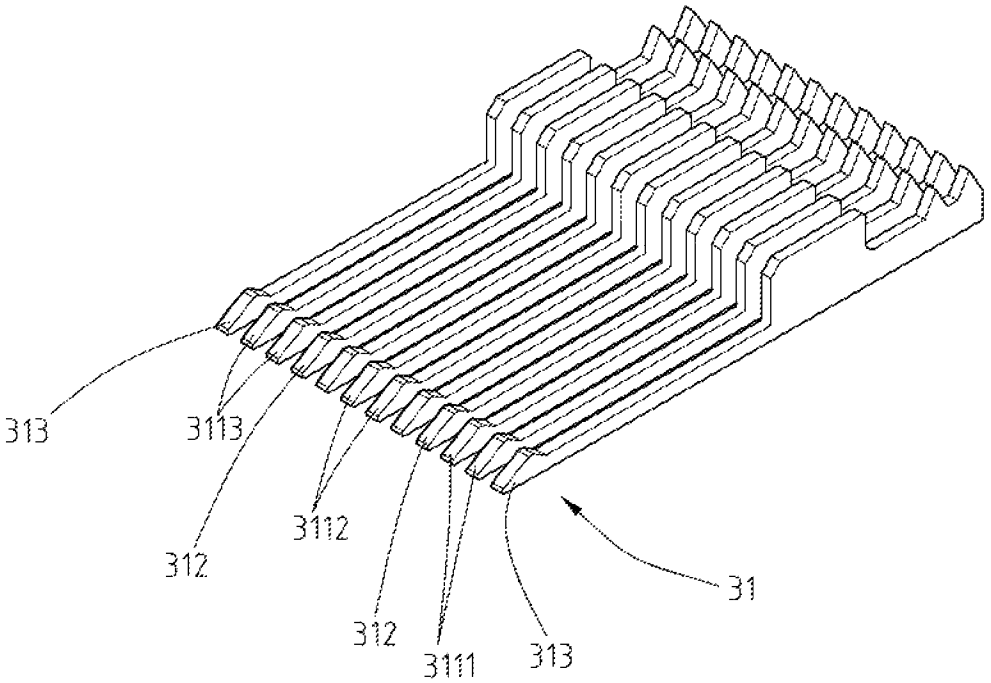
FIG. 10 illustrates a perspective view of an electrical plug connector with one row of plug terminals according to a second embodiment of the instant disclosure.
Figure 13:
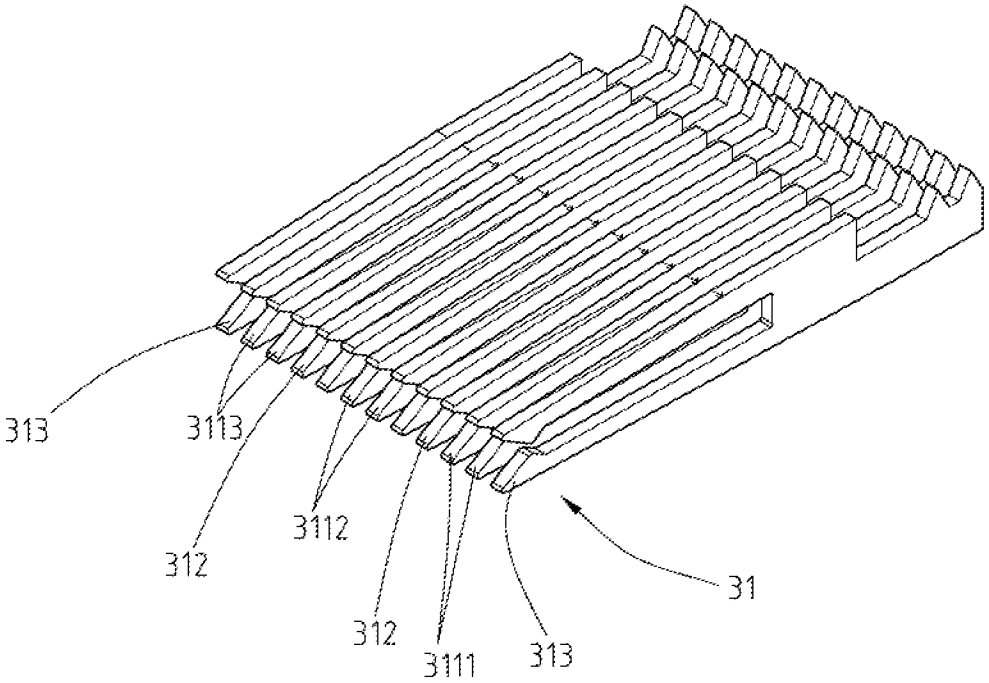
FIG. 13 illustrates a perspective view of an electrical plug connector with two rows of plug terminals according to a third embodiment of the instant disclosure.

Please refer to FIGS. 2 and 3. The wire organizer 7 is an elongated block and assembled in the assembling groove 22 of the insulated housing 21. The wire organizer 7 comprises a block body 71, a plurality of wire grooves 72, and a plurality of cut grooves 73. Each of the wire grooves 72 is defined through the block body 71. Each of the cut grooves 73 is formed at a bottom of the block body 71 and communicating with the corresponding wire groove 72. Each of the tooth portions 51 is inserted into the corresponding wire groove 72 from the corresponding cut groove 73. The turning portions 317 of the tooth portions 51 are for adjusting the distance between extending portions 511, so that the extending portions 511 are inserted into the cut grooves 73 and puncture the surface of the wires 9, respectively. In this embodiment, the wire organizer 7 comprises four wire grooves 72 for the insertion of the wires 9, and the four wire grooves 72 correspond to four cut grooves 73 for being inserted by four tooth portions 51, respectively, but embodiment are not limited thereto. In some embodiments, if the electrical plug connector 100 has twelve plug terminals 31 (as shown in FIGS. 10 and 13), twelve tooth structures 51, twelve wire grooves 72, twelve cut grooves 73, and twelve wires 9 are provided with the electrical plug connector 100.

Please refer to FIGS. 4, 5, 8, and 9. The wire organizer 7 is assembled in the assembling groove 22 of the insulated housing 21 as described below. The insulated housing 21 comprises a plurality of buckling grooves 221 and a plurality of engaging grooves 222. The buckling grooves 221 are recessed from the inner walls of two sides of the assembling groove 22, and the engaging grooves 222 are recessed from two sidewalls of the assembling groove 22. The wire organizer 7 comprises a plurality of protruding blocks 74 and a plurality of engaging blocks 75. The protruding blocks 74 are protruding from two sides of the block body 71. The engaging blocks 75 are protruding from the two sides of the block body 71 and atop the protruding blocks 74, respectively. When the wire organizer 7 assembled with the wires 9 is to be assembled to the insulated housing 21, the wire organizer 7 is aimed at and assembled into the assembling groove 22 from the top of the assembling groove 22, the protruding blocks 74 are engaged with the buckling grooves 221 so that the vertical movement of the wire organizer 7 in the assembling groove 22 can be restricted, and the engaging blocks 75 are engaged with the engaging grooves 222 so that the lateral movement of the wire organizer 7 in the assembling groove 22 can be restricted. Hence, the tooth portions 51 can puncture the surface of the wires 9, so that the sharp end portions 512 of each of the tooth portions 51 are in contact with the sub wires of the corresponding wire 9 for conduction.

Figure 8:
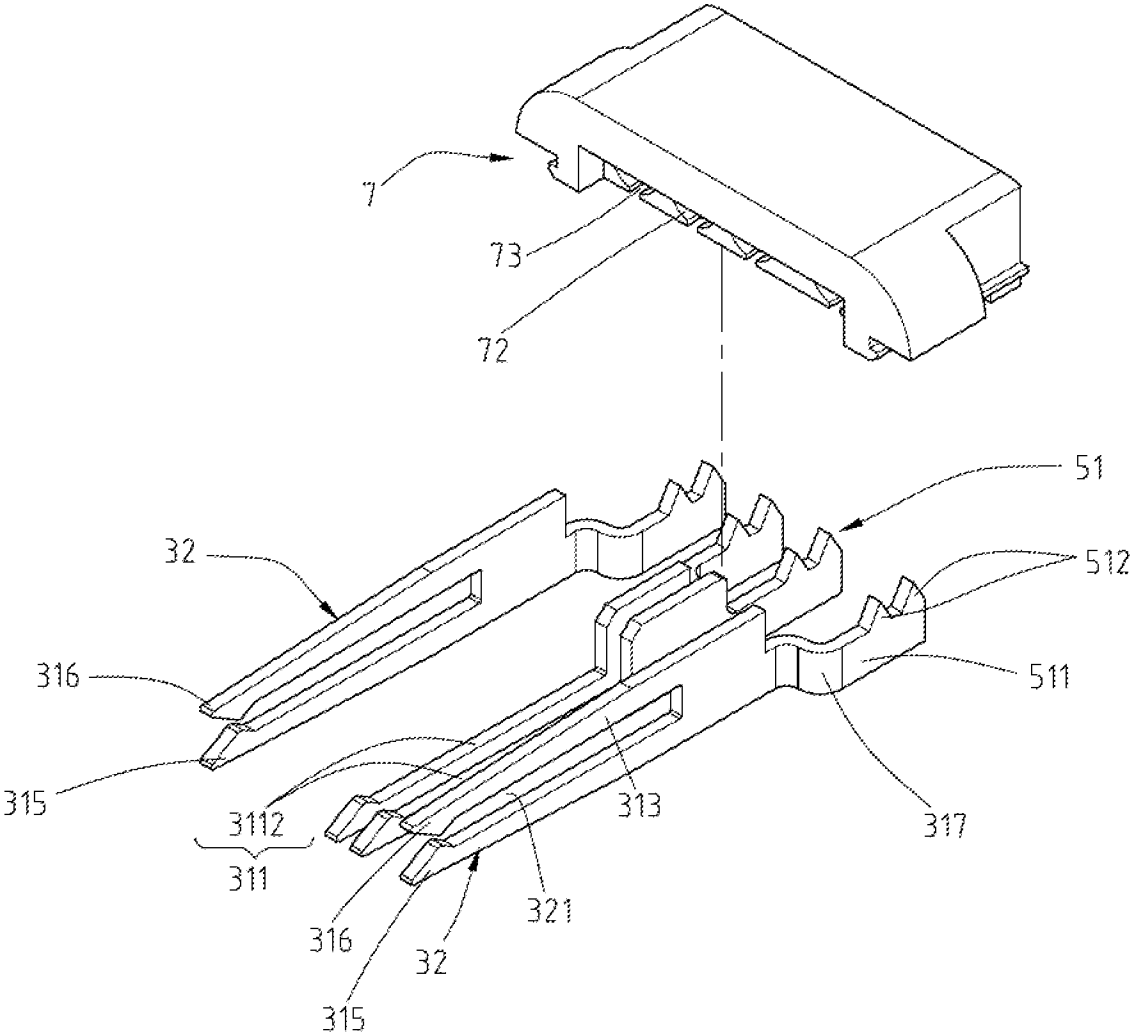
FIG. 8 illustrates an exploded view of the wire organizer and the plug terminals of the electrical plug connector of the first embodiment.
Figure 9:
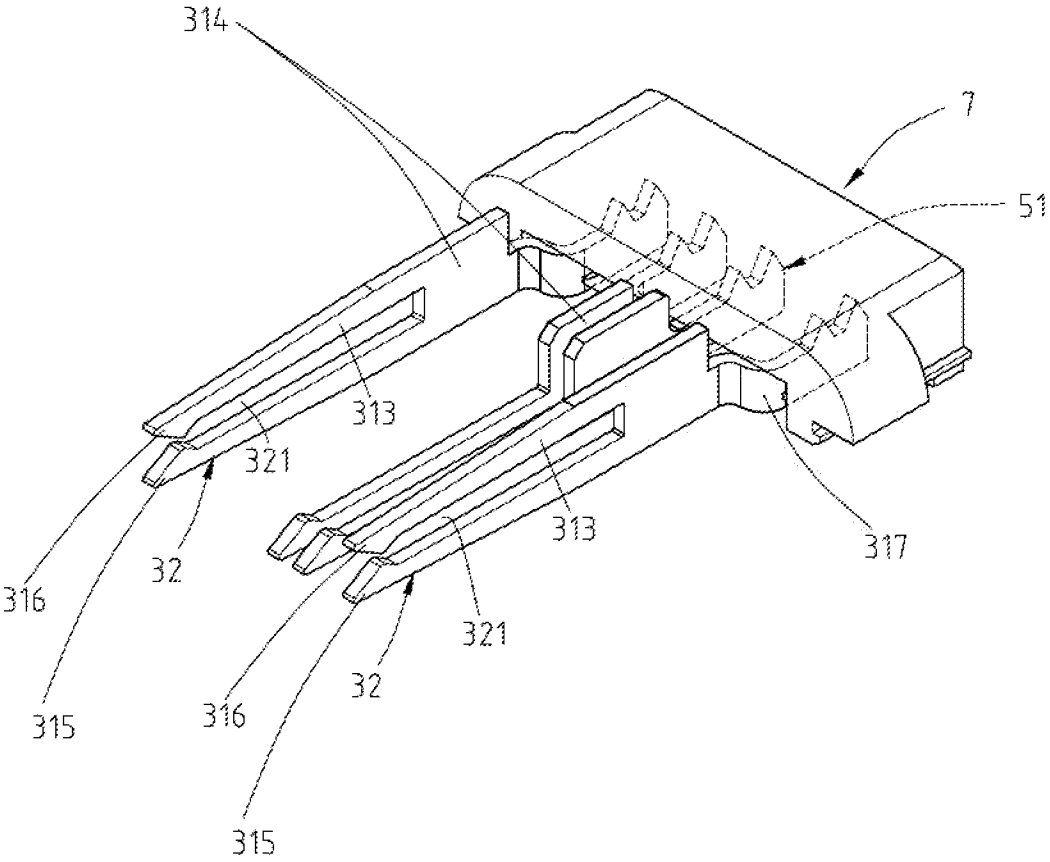
FIG. 9 illustrates an assembled view of the wire organizer and the plug terminals of the electrical plug connector of the first embodiment.

Please refer to FIGS. 2, 6, and 8. The electrical plug connector 100 further comprises a plurality of engaging members 52 respectively at two sides of the insulated housing 21. The insulated housing 21 and the engaging members 52 may be formed with each other by insert-molded technique or the like. Alternatively, the engaging members 52 may be assembled with the insulated housing 21. In the latter configuration, the insulated housing 21 has through slots at two sides thereof for positioning the engaging members 52, respectively. Each of the engaging members 52 comprises a hook portion 521 and a protruding contact portion 522 and an end portion 523. The hook portions 521 are respectively positioned with the two sides of the insulated housing 21, and between the protruding contact portion 522 and the end portion 523. The outer surfaces of the hook portions 521 are in contact with the inner wall of the metallic shell 11, and the hook portion 521 has a hook block 5211 extending toward the mating room 213. The protruding contact portions 522 are extending from the fronts of the hook portions 521 and inserted into the side portions of the mating room 213, respectively. The end portion 523 and the protruding contact portion 522 are at two opposite sides of the hook portions 521, respectively. The end portion 523 also has an extending block 5231 extending toward the mating room 213. When the electrical plug connector 100 is mated with an electrical receptacle connector, buckling pieces at two sides of the electrical receptacle connector are in contact with the protruding contact portions 522. Therefore, the electrical plug connector 100 is positioned with the electrical receptacle connector by the engaging members 52, and noises can be grounded and conducted when the electrical plug connector 100 is mated with an electrical receptacle connector.

In this embodiment, the electrical plug connector 100 may be mated with an electrical receptacle connector in either of two intuitive orientations, i.e., in either upside-up or upside-down directions, and the plug terminals 31 of the electrical plug connector 100 may be in contact with upper receptacle terminals or lower receptacle terminals of the electrical receptacle connector. Specifically, the clamping structure 32 of the ground terminal 313 and the clamping structure 32 of the power terminal 312 may be respectively in contact with the ground terminal and the power terminal of the receptacle terminals of the electrical receptacle connector, and the signal terminals 311 may be in contact with upper signal terminals or lower signal terminals of the receptacle terminal of the electrical receptacle connector. In other words, the electrical plug connector 100 may be mated with the electrical receptacle connector in dual directions, and the plug terminals 31 of the electrical plug connector 100 may be in contact with upper receptacle terminals or lower receptacle terminals of the electrical receptacle connector. Therefore, the inserting orientation of the electrical plug connector 100 is not limited by the electrical receptacle connector.

Figure 11:
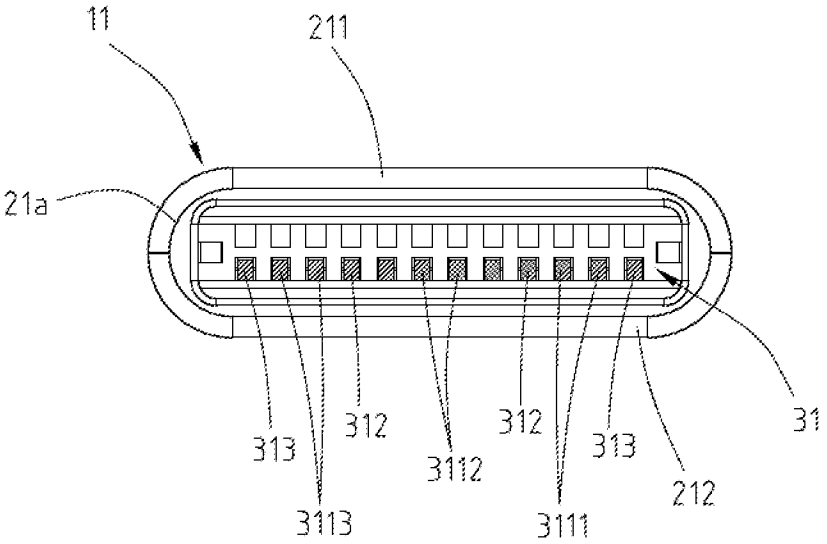
FIG. 11 illustrates a front sectional view of the electrical plug connector of the second embodiment.
Figure 12:
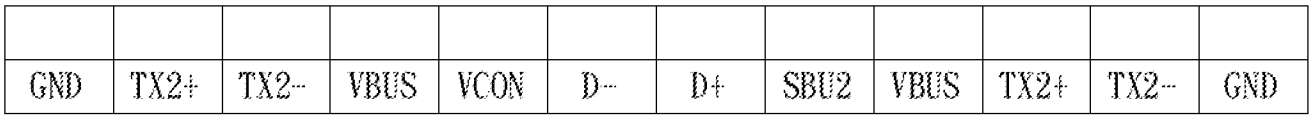
FIG. 12 illustrates a schematic configuration diagram of the plug terminals of the electrical plug connector shown in FIG. 11.

Please refer to FIGS. 10 to 12, illustrating a second embodiment of the instant disclosure. In the second embodiment, the electrical plug connector 100 comprises twelve plug terminals 31 for transmitting USB 3.0 signals (i.e., for high-speed signal transmission); while in the first embodiment, the electrical plug connector 100 comprises four plug terminals 31 for transmitting USB 2.0 signals (i.e., for low-speed signal transmission). Furthermore, in the second embodiment, the plug terminals 100 have similar or the same structure, and devoid of the clamping structure 32 shown in the first embodiment. In other words, in this embodiment, each of the plug terminals 31 comprises the first flexible contact portion 315 or the second flexible contact portion 316. In this embodiment, the flexible contact portion (the first flexible contact portion 315 or the second flexible contact portion 316) of each of the plug terminals 31 may be held at the first mating surface of the first portion 211 or the second mating surface of the second portion 212. That is, the flexible contact portions may be formed as the upper plug terminals or the lower plug terminals in the mating room 213. Specifically, in this embodiment, the tooth portion 51 is extending from the rear of each of the plug terminals 31 for puncturing the surface of the corresponding wire 9, so that the sharp end portions 512 of each of the tooth portions 51 puncture the corresponding wire 9 and are in contact with the sub wires of the wire 9 for conduction. The number of the wires 9 corresponds to the number of the plug terminals 31.

Please refer to FIGS. 10 to 12. In the second embodiment, the plug terminals 31 are arranged as a single row. The plug terminals 31 comprise a plurality of signal terminals 311, at least one power terminal 312, and at least one ground terminal 313. In the case the plug terminals 31 comprise the second flexible contact portions 316, as shown in FIG. 12, the plug terminals 31 comprise, from right to left, a ground terminal 313 (Gnd), a first pair high-speed signal terminals 3111 (TX2+−, differential signal terminals), a power terminal 312 (Power/VBUS), a secondary bus terminal (SBU2), a pair of low-speed signal terminals 3112 (D+−, differential signal terminals), a Vcon terminal (VCON), another power terminal 312 (Power/VBUS), a second pair of high-speed signal terminals 3113 (TX2+−, differential signal terminals), and another ground terminal 313 (Gnd).

In the aforementioned embodiment, the electrical plug connector 100 has twelve plug terminals 31 for USB 3.0 signal transmission, but embodiments are not limited thereto. In some embodiments, the first pair of high-speed signal terminals 3111 (TX2+−), the second pair of high-speed signal terminals 3113 (TX2+−), and the secondary bus terminal (SBU2) are omitted, and the rest seven plug terminals 31 are provided for USB 2.0 signal transmission. In other words, according to embodiments of the instant disclosure, the electrical plug connector 100 comprises plug terminals 31 aligned in a single row (either as upper plug terminals or as lower plug terminals). In addition, the number of the plug terminals 31 may be further reduced to seven. In the illustrative embodiment, the plug terminals 31 are lower plug terminals of the electrical plug connector 100, but embodiments are not limited thereto. The plug terminals 31 may be the upper plug terminals of the electrical plug connector 100. Moreover, the plug terminals 31 of the electrical plug connector 100 may be in contact with upper receptacle terminals or lower receptacle terminals of the electrical receptacle connector. Therefore, the inserting orientation of the electrical plug connector 100 is not limited by the electrical receptacle connector.

Figure 14:
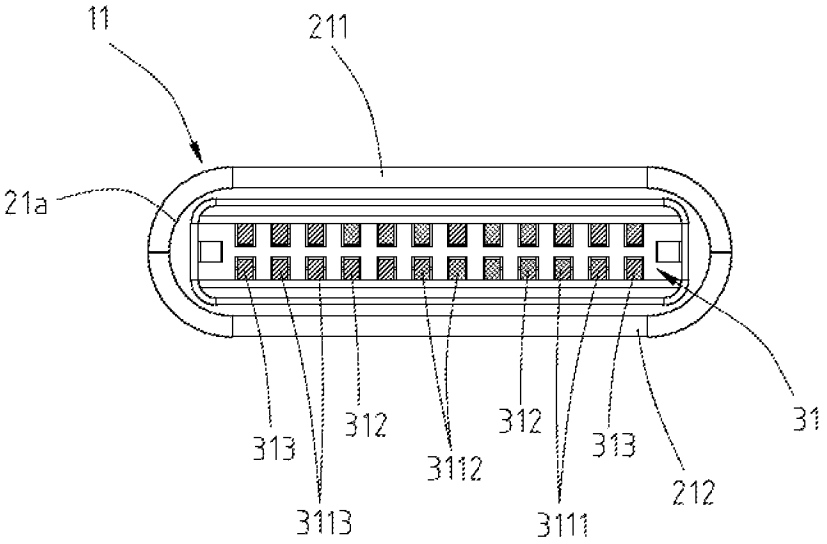
FIG. 14 illustrates a front sectional view of the electrical plug connector of the third embodiment.

Please refer to FIGS. 13 and 14, illustrating a third embodiment of the instant disclosure. In this embodiment, each of the plug terminals 31 comprises the clamping structure 32 shown in the first embodiment, and the electrical plug connector 100 of the third embodiment also comprises twelve plug terminals 31, so that the first flexible contact portions 315 and the second flexible contact portions 316 are received in the mating room 213 and respectively as upper and lower plug terminals. In other words, in the third embodiment, each of the plug terminals 31 comprises the clamping structure 32; i.e., each of the signal terminals 311, the power terminal 312, and the ground terminal 313 comprises the clamping structure 32; while in the first embodiment, only the power terminal 312 and the ground terminal 313 comprise the clamping structures 32.

In the third embodiment, the plug terminals 31 are arranged as a single row. The plug terminals 31 comprise the clamping structures 32, so that the first flexible contact portions 315 and the second flexible contact portions 316 are formed as terminals in dual rows. in other words, the first flexible contact portions 315 and the second flexible contact portions 316 are arranged in the upper portion and the lower portion of the mating room 213, respectively, for signal and/or power transmission by mating with an electrical receptacle connector in dual orientations. In the third embodiment, the plug terminals 31 comprise a plurality of signal terminals 311, at least one power terminal 312, and at least one ground terminal 313. The first flexible contact portions 315 of the plug terminals 31 comprise, from right to left, a ground terminal 313 (Gnd), a first pair high-speed signal terminals 3111 (TX2+−, differential signal terminals), a power terminal 312 (Power/VBUS), a reserved terminal, a pair of low-speed signal terminals 3112 (D+−, differential signal terminals), another reserved terminal, another power terminal 312 (Power/VBUS), a second pair of high-speed signal terminals 3113 (TX2+−, differential signal terminals), and another ground terminal 313 (Gnd). The second flexible contact portions 316 of the plug terminals 31 comprise, from left to right, a ground terminal 313 (Gnd), a first pair high-speed signal terminals 3111 (TX2+−, differential signal terminals), a power terminal 312 (Power/VBUS), a reserved terminal, a pair of low-speed signal terminals 3112 (D+−, differential signal terminals), another reserved terminal, another power terminal 312 (Power/VBUS), a second pair of high-speed signal terminals 3113 (RX1+−, differential signal terminals), and another ground terminal 313 (Gnd).

In this embodiment, because the first flexible contact portion 315 and the second flexible contact portion 316 of each of the clamping structure 32 are integrally formed with each other, the first flexible contact portion 315 and the second flexible contact portion 316 of each of the plug terminals 31 have the same pin configuration. For example, for the same clamping structure 32, if the first flexible contact portion 315 is the ground terminal 313, the second flexible contact portion 316 is also the ground terminal 313; for two adjacent clamping structures 32, if the first flexible contact portions 315 are the first pair of high-speed signal terminals 3111 (TX2+−, differential signal terminals), the second flexible contact portions 316 are the first pair of high-speed signal terminals 3111 (TX2+−, differential signal terminals), and vise versa.

In this embodiment, an electronic device for connecting with the electrical plug connector 100 further comprises an IC chip. When the electrical plug connector 100 is mated with an electrical receptacle connector in either two orientations, the IC chip can detect the pin assignments of the electrical receptacle connector and changes the pin assignments of the first flexible contact portions 315 and the second flexible contact portions 316 of the plug terminals 31 for meeting with the pin assignments of the electrical receptacle connector. In other words, the IC chip can instantly change the pin assignments of the first flexible contact portions 315 and the second flexible contact portions 316 into the pin assignments shown in FIG. 15. Therefore, when the electrical plug connector 100 is mated with an electrical receptacle connector in either of two orientations, the pin assignments of the electrical plug connector 100 and the pin assignments of the respective receptacle connector are matched. In other words, the first pair of high-speed signal terminals 3111 (TX1+− or RX1+−, differential signal terminals) of the plug terminals 31 corresponds to the first pair of high-speed signal terminals (TX1+− or RX1+−, differential signal terminals) of the receptacle terminals, the pair of low-speed signal terminals 3112 (D+−, differential signal terminals) of the plug terminals 31 corresponds to the pair of low-speed signal terminals (D+−, differential signal terminals) of the receptacle terminals, and the second pair of high-speed signal terminals 3113 (RX2+– or TX2+–, differential signal terminals) of the plug terminals 31 corresponds to the second pair of high-speed signal terminals (RX2+– or TX2+–, differential signal terminals) of the receptacle terminals. Accordingly, when the electrical plug connector 100 is mated with the electrical receptacle connector in either of two orientations, short circuit problems caused by mismatch between the plug terminals 31 and the receptacle terminals can be prevented.

Please refer to FIGS. 13 and 14. In this embodiment, the first flexible contact portions 315 and the second flexible contact portions 316 of the plug terminals 31 are respectively held at the first mating surface of the first portion 211 and the second mating surface of the second portion 212. Moreover, pin-assignments of the first flexible contact portion 315 and the second flexible contact portions 316 are point-symmetrical with a central point of the receiving cavity 111 as the symmetrical center. In other words, pin-assignments of the first flexible contact portions 315 and the second flexible contact portions 316 have 180 degree symmetrical design with respect to the central point of the receiving cavity 111 as the symmetrical center. The dual or double orientation design enables the electrical plug connector 100 to be inserted into an electrical receptacle connector in either of two intuitive orientations, i.e., in either upside-up or upside-down directions. Here, point-symmetry means that after the first flexible contact portions 315 (or the second flexible contact portions 316), are rotated by 180 degrees with the symmetrical center as the rotating center, the first flexible contact portions 315 and the second flexible contact portions 316 are overlapped. That is, the rotated first flexible contact portions 315 are arranged at the position of the original second flexible contact portions 316, and the rotated second flexible contact portions 316 are arranged at the position of the original first flexible contact portions 315. In other words, the first flexible contact portions 315 and the second flexible contact portions 316 are arranged upside down, and the pin assignments of the first flexible contact portions 315 are left-right reversal with respect to that of the second flexible contact portions 316. In this embodiment, the inserting orientation of the electrical plug connector 100 to an electrical receptacle connector can be detected by the IC chip. Therefore, the electrical plug connector 100 may be inserted into an electrical receptacle connector with a first orientation where the first mating surface is facing down, for transmitting first signals. Conversely, the electrical plug connector 100 may also be inserted into the electrical receptacle connector with a second orientation where the first mating surface is facing up, for transmitting second signals. Furthermore, the specification for transmitting the first signals is conformed to the specification for transmitting the second signals. Note that, the inserting orientation of the electrical plug connector 100 is not limited by the electrical receptacle connector.

Please refer to FIG. 14. In this embodiment, the positions of the plug terminals 31 correspond to each other. In other words, the first flexible contact portions 315 of the plug terminals 31 are aligned with the second flexible contact portions 316 of the plug terminals 31. In some embodiment, the first flexible contact portions 315 may be aligned by an offset with respect to the second flexible contact portions 316. In other words, the first flexible contact portions 315 do not align with the second flexible contact portions 316. Accordingly, the crosstalk between the first flexible contact portions 315 and the second flexible contact portions 316 can be reduced during signal transmission because of the offset alignment of the first flexible contact portions and the second flexible contact portions 316. It is understood that, when the first flexible contact portions 315 and the second flexible contact portions 316 of the electrical plug connector 100 have the offset alignment, receptacle terminals of an electrical receptacle connector to be mated with the electrical plug connector 100 would also have the offset alignment. Hence, the receptacle terminals of the electrical receptacle connector can be in contact with the first flexible contact portions and the second flexible contact portions 316 of the electrical plug connector 100 for power and/or signal transmission.

Based on the above, the first flexible contact portions 315 and the second flexible contact portions 316 of the plug terminals 31 may be formed as upper and lower terminals received in the mating room 213. Alternatively, the first flexible contact portions 315 of the plug terminals 31 may be formed as the upper terminals or lower terminals received in the mating room 213. In a further option, the first flexible contact portions 315 and the second flexible contact portions 316 of some of the plug terminals 31 may be formed as dual-row terminals, and the first flexible contact portions 315 of rest of the plug terminals 31 are formed as terminals in one row. Hence, these plug terminals 31 may be adapted optionally based on needs. In addition, the number of the plug terminals 31 may be reduced without removing the function of power and signal transmission. Furthermore, the rear of each of the plug terminals 31 comprises the tooth portion 51.

The first flexible contact portion, the second flexible contact portion, and the body portion of each of the power terminal and the ground terminal are formed as the clamping structure. Therefore, the power terminal and the ground terminal can be assembled to the insulated housing by one-time assembling, and the first flexible contact portions and the second flexible contact portions can be received in the mating room and provided as upper and lower terminals. Hence, the conventional problem that the upper terminals and the lower terminals have to be assembled to the insulated housing in a separate and complicated manner can be solved. In addition, the tooth portions of the plug terminals can puncture the surface of the wires, so that the sharp end portions of the plug terminals can be in contact with the sub wires of the wires for electrical conduction. As a result, the complicated soldering procedure adapted in the conventional way for the connection of terminals and wires can be replaced. In addition, the tooth portions may be extending from the rears of the plug terminals each having the first flexible contact portion and the second flexible contact portion. Alternatively, the tooth portions may be extending from the rears of the plug terminals having the first flexible contact portions or the second flexible contact portions. In a further option, the tooth portions may be extending from the rears of the plug terminals in which some of the plug terminals have the first flexible contact portion and the second flexible contact portion.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a metallic shell defining a receiving cavity therein;

an insulated housing received in the receiving cavity of the metallic shell, wherein the insulated housing comprises a base portion, a tubular portion, a mating room, an assembling groove, a plurality of buckling grooves, and a plurality of engaging grooves, wherein the tubular portion comprises a first portion and a second portion, and the tubular portion is extending from one of two sides of the base portion, and the mating room is between the first portion and the second portion, wherein the first portion has a first mating surface, the second portion has a second mating surface, and the first mating surface faces the second mating surface, and wherein the assembling groove is formed at the other side of the base portion, and wherein the buckling grooves are recessed from inner walls of two sides of the assembling groove, and the engaging grooves are recessed from two sidewalls of the assembling groove;

a plurality of plug terminals comprising a plurality of signal terminals, a power terminal, and a ground terminal, wherein each of some of the plug terminals comprises a first flexible contact portion, a second flexible contact portion, and a body portion, wherein the body portions are held in the base portion, for each of the signal terminals, the first flexible contact portion is extending from one of two ends of the body portion, held at the first mating surface of the first portion or at the second mating surface of the second portion, and projected into the mating room, wherein for each of the power terminal and the ground terminal, the first flexible contact portion, the second flexible contact portion, and the body portion are formed as a clamping structure, for each of the clamping structures, the first flexible contact portion is extending upward from the end of the body portion and at the first mating surface of the first portion and projected into the mating room, and the second flexible contact portion is extending downward from the end of the body portion and at the second mating surface of the second portion and projected into the mating room;

a plurality of tooth portions each extending from the other end of each of the body portions and extending toward the assembling groove; and a wire organizer assembled in the assembling groove of the insulated housing, wherein the wire organizer comprises a block body, a plurality of wire grooves, a plurality of cut grooves, a plurality of protruding blocks, and a plurality of engaging blocks, each of the wire grooves is defined through the block body, each of the cut grooves is formed at a bottom of the block body and communicating with the corresponding wire groove, and wherein each of the tooth portions is inserted into the corresponding wire groove from the corresponding cut groove, the protruding blocks are protruding from two sides of the block body and engaged with the buckling grooves, and the engaging blocks are protruding from the two sides of the block body and atop the protruding blocks and engaged with the engaging grooves, respectively.

2. The electrical plug connector according to claim 1, wherein each of the tooth portions comprises an extending portion and a plurality of sharp end portions, the extending portion of each of the tooth portions is extending from the other end of the corresponding body portion toward the assembling groove, and the sharp end portions are extending from a top of the extending portion of each of the tooth portions and located in the corresponding wire groove.

3. The electrical plug connector according to claim 1, wherein each of the clamping structures comprises a clamping region formed between the first flexible contact portion and the second flexible contact portion.

4. The electrical plug connector according to claim 1, further comprising a plurality of wires inserted into the wire grooves, wherein each of the tooth portions punctures the corresponding wire.

5. The electrical plug connector according to claim 1, further comprising a plurality of engaging members respectively at two sides of the insulted housing, wherein each of the engaging members comprises a hook portion and a protruding contact portion, the protruding contact portion is extending from the front of the hook portion toward the mating room of the insulated housing, and the hook portions are respectively fixed with the two sides of the insulated housing.

6. The electrical plug connector according to claim 1, wherein the base portion comprises a plurality of assembling slots defined through the inner wall of the recessed groove and communicating with the mating room, the width of the body portion is greater than the width of the first flexible contact portion or the width of the second flexible contact portion, and the side portion of each of the body portions is abutted against the corresponding assembling slot.

7. The electrical plug connector according to claim 2, wherein each of the plug terminals further comprises a turning portion, the turning portion is extending between the extending portion and the body portion.

8. An electrical plug connector, comprising:

a metallic shell defining a receiving cavity therein;

an insulated housing received in the receiving cavity of the metallic shell, wherein the insulated housing comprises a base portion, a tubular portion, a mating room, an assembling groove, a plurality of buckling grooves and a plurality of engaging grooves, wherein the tubular portion comprises a first portion and a second portion, and the tubular portion is extending from one of two sides of the base portion, and the mating room is between the first portion and the second portion, wherein the first portion has a first mating surface, the second portion has a second mating surface, and the first mating surface faces the second mating surface, and wherein the assembling groove is formed at the other side of the base portion, and wherein the buckling grooves are recessed from the inner walls of two sides of the assembling groove, and the engaging grooves are recessed from two sidewalls of the assembling groove;

a plurality of plug terminals comprising a plurality of signal terminals, at least one power terminal, and at least one ground terminal, wherein each of the plug terminals comprises a first flexible contact portion and a body portion, the body portion is held in the base portion, the first flexible contact portion is extending from one of two ends of the body portion, held at the first mating surface of the first portion or the second mating surface of the second portion, and projected into the mating room;

a plurality of tooth portions each extending from the other end of each of the body portions and extending toward the assembling groove; and a wire organizer assembled in the assembling groove of the insulated housing, wherein the wire organizer comprises a block body, a plurality of wire grooves, a plurality of cut grooves, a plurality of protruding blocks and a plurality of engaging blocks, each of the wire grooves is defined through the block body, each of the cut grooves is formed at a bottom of the block body and communicating with the corresponding wire groove, and wherein each of the tooth portions is inserted into the corresponding wire groove from the corresponding cut groove, and wherein the protruding blocks are protruding from two sides of the block body, the engaging blocks are protruding from the two sides of the block body and atop the protruding blocks, respectively, the protruding blocks are engaged with the buckling grooves, and the engaging blocks are engaged with the engaging grooves.

9. The electrical plug connector according to claim 8, wherein each of the tooth portions comprises an extending portion and a plurality of sharp end portions, the extending portion of each of the tooth portions is extending from the other end of the corresponding body portion toward the assembling groove, and the sharp end portions are at a top of the extending portion of each of the tooth portions, spaced from each other, and located in the corresponding wire groove.

10. The electrical plug connector according to claim 8, further comprising a plurality of wires inserted into the wire grooves, wherein each of the tooth portions punctures the corresponding wire.

11. The electrical plug connector according to claim 8, further comprising a plurality of engaging members respectively at two sides of the insulted housing, wherein each of the engaging members comprises a hook portion, a protruding contact portion, and an end portion, the protruding contact portion is extending from the front of the hook portion toward the mating room of the insulated housing, the hook portions are respectively fixed with the two sides of the insulated housing, and each of the hook portion has a hook block extending toward the mating room, the end portion and the protruding contact portion are at two sides of the hook portion and has an extending block extending toward the mating room.

12. The electrical plug connector according to claim 8, wherein the base portion comprises a plurality of assembling slots defined through the inner wall of the recessed groove and communicating with the mating room, the width of the body portion is greater than the width of the first flexible contact portion or the width of the second flexible contact portion, and the side portion of each of the body portions is abutted against the corresponding assembling slot.

13. An electrical plug connector, comprising:

a metallic shell defining a receiving cavity therein;

an insulated housing received in the receiving cavity of the metallic shell, wherein the insulated housing comprises a base portion, a tubular portion, a mating room, and an assembling groove, wherein the tubular portion comprises a first portion and a second portion, and the tubular portion is extending from one of two sides of the base portion, and the mating room is between the first portion and the second portion, wherein the first portion has a first mating surface, the second portion has a second mating surface, and the first mating surface faces the second mating surface, and wherein the assembling groove is formed at the other side of the base portion;

a plurality of plug terminals comprising a plurality of signal terminals, at least one power terminal, and at least one ground terminal, wherein each of the plug terminals comprises a first flexible contact portion, a second flexible contact portion, and a body portion, wherein the body portions are held in the base portion, the first flexible contact portion is extending upward from one of two ends of the body portion, held at the first mating surface of the first portion and projected into the mating room, the second flexible contact portion is extending downward from the end of the body portion, held at the second mating surface of the second portion, and projected into the mating room, wherein the first flexible contact portion, the second flexible contact portion, and the body portion of each of the plug terminals are formed as a clamping structure, for each of the clamping structures, the first flexible contact portion is extending upward from the end of the body portion and at the first mating surface of the first portion and projected into the mating room, and the second flexible contact portion is extending downward from the end of the body portion and at the second mating surface of the second portion and projected into the mating room;

a plurality of tooth portions each extending from the other end of each of the body portions and extending toward the assembling groove;

a wire organizer assembled in the assembling groove of the insulated housing, wherein the wire organizer comprises a block body, a plurality of wire grooves, and a plurality of cut grooves, each of the wire grooves is defined through the block body, each of the cut grooves is formed at a bottom of the block body and communicating with the corresponding wire groove, and wherein each of the tooth portions is inserted into the corresponding wire groove from the corresponding cut groove; and a plurality of engaging members respectively at two sides of the insulted housing, wherein each of the engaging members comprises a hook portion, a protruding contact portion, and an end portion, the protruding contact portion is extending from the front of the hook portion toward the mating room of the insulated housing, the hook portions are respectively fixed with the two sides of the insulated housing, and each of the hook portion has a hook block extending toward the mating room, the end portion and the protruding contact portion are at two sides of the hook portion and has an extending block extending toward the mating room.

14. The electrical plug connector according to claim 13, wherein each of the tooth portions comprises an extending portion and a plurality of sharp end portions, the extending portion of each of the tooth portions is extending from the other end of the corresponding body portion toward the assembling groove, and the sharp end portions are at a top of the extending portion of each of the tooth portions, spaced from each other and located in the corresponding wire groove.

15. The electrical plug connector according to claim 13, wherein each of the clamping structures comprises a clamping region formed between the first flexible contact portion and the second flexible contact portion.

16. The electrical plug connector according to claim 13, further comprising a plurality of wires inserted into the wire grooves, wherein each of the tooth portions punctures the corresponding wire.

17. The electrical plug connector according to claim 13, wherein the insulated housing further comprises a plurality of buckling grooves and a plurality of engaging grooves, and the wire organizer further comprises a plurality of protruding blocks and a plurality of engaging blocks, wherein the buckling grooves are recessed from the inner walls of two sides of the assembling groove, and the engaging grooves are recessed from two sidewalls of the assembling groove, the protruding blocks are protruding from two sides of the block body, the engaging blocks are protruding from the two sides of the block body and atop the protruding blocks, respectively, the protruding blocks are engaged with the buckling grooves, and the engaging blocks are engaged with the engaging grooves.

18. An electrical plug connector, comprising:

a metallic shell defining a receiving cavity therein;

an insulated housing received in the receiving cavity of the metallic shell, wherein the insulated housing comprises a base portion, a tubular portion, a mating room, and an assembling groove, wherein the tubular portion comprises a first portion and a second portion, and the tubular portion is extending from one of two sides of the base portion, and the mating room is between the first portion and the second portion, wherein the first portion has a first mating surface, the second portion has a second mating surface, and the first mating surface faces the second mating surface, and wherein the assembling groove is formed at the other side of the base portion;

a plurality of plug terminals comprising a plurality of signal terminals, a power terminal, and a ground terminal, wherein each of the signal terminals comprises a first flexible contact portion and a body portion, each of the power terminal and the ground terminal comprises a first flexible contact portion, a second flexible contact portion, and a body portion, wherein the body portions are held in the base portion, the first flexible contact portion of each of the signal terminals is extending from one of two ends of the body portion, held at the first mating surface of the first portion or the second mating surface of the second portion and projected into the mating room, wherein for each of the power terminal and the ground terminal, the first flexible contact portion and the second flexible contact portion are oppositely extending from the end of the body portion, held at the first mating surface of the first portion and the second mating surface of the second portion and projected into the mating room, respectively;

a plurality of tooth portions each extending from the other end of each of the body portions and extending toward the assembling groove;

a wire organizer assembled in the assembling groove of the insulated housing, wherein the wire organizer comprises a block body, a plurality of wire grooves, and a plurality of cut grooves, each of the wire grooves is defined through the block body, each of the cut grooves is formed at a bottom of the block body and communicating with the corresponding wire groove, and wherein each of the tooth portions is inserted into the corresponding wire groove from the corresponding cut groove; and a plurality of engaging members respectively at two sides of the insulted housing, wherein each of the engaging members comprises a hook portion, a protruding contact portion, and an end portion, the protruding contact portion is extending from the front of the hook portion toward the mating room of the insulated housing, the hook portions are respectively fixed with the two sides of the insulated housing, and each of the hook portion has a hook block extending toward the mating room, the end portion and the protruding contact portion are at two sides of the hook portion and has an extending block extending toward the mating room.

19. The electrical plug connector according to claim 18, wherein the insulated housing further comprises a plurality of buckling grooves and a plurality of engaging grooves, and the wire organizer further comprises a plurality of protruding blocks and a plurality of engaging blocks, wherein the buckling grooves are recessed from the inner walls of two sides of the assembling groove, and the engaging grooves are recessed from two sidewalls of the assembling groove, the protruding blocks are protruding from two sides of the block body, the engaging blocks are protruding from the two sides of the block body and atop the protruding blocks, respectively, the protruding blocks are engaged with the buckling grooves, and the engaging blocks are engaged with the engaging grooves.

* * * * *